US005769426A

United States Patent [19]

Gill

[11] Patent Number: 5,769,426

[45] Date of Patent: Jun. 23, 1998

[54] TWO PERSON TUG OF WAR

[76] Inventor: Michael Mintaek Gill, 3250 Wilshire Blvd. Suite 2009, Los Angeles, Calif. 90010

[21] Appl. No.: 850,179

[22] Filed: May 2, 1997

[51] Int. Cl.[6] ..... A63B 67/00

[52] U.S. Cl. ..... 273/452

[58] Field of Search ..... 273/440, 451, 273/452; 482/91, 92, 139

[56] References Cited

U.S. PATENT DOCUMENTS

| | | | |
|---|---|---|---|
| 3,129,940 | 4/1964 | Lauro | 273/451 X |
| 3,301,555 | 1/1967 | Sicherman | 273/451 |
| 3,323,796 | 6/1967 | Carlson | 273/451 |
| 4,211,402 | 7/1980 | Carroll | 273/451 X |
| 4,463,949 | 8/1984 | McCoy, Sr. et al. | 273/451 |
| 4,846,468 | 7/1989 | McCoy, Sr. et al. | 273/451 |
| 5,512,028 | 4/1996 | Sparks, III | 482/92 |
| 5,674,159 | 10/1997 | Davidson | 482/92 |

*Primary Examiner*—William E. Stoll

[57] ABSTRACT

The two person tug of war apparatus comprises a frame having a first hand grip and a second hand grip. Another form of the two person tug of war comprises a first hand grip and a second hand grip rotatably connected to each other by one or more swivel joints. The swivel joints may be fully rotatable or rotatable only to a limited degree. For sport or exercise, two person may play the tug of war game using the invented devices. Each player stands on his/her footing each holding a hand grip. Each player then tries to pull or cause the other player to lose balance. The player who first moves his foot, touches the other player, or touches the ground loses.

19 Claims, 8 Drawing Sheets

TWO PERSON TUG OF WAR

BACKGROUND OF THE INVENTION

The field of this invention is a tug of war game device which can be played by two persons.

Tug of war games by two persons are known to people. However, most players play with bear hands and not many game devices are known.

SUMMARY OF THE INVENTION

The present invention is directed to tug of war game devices. These devices are designed to be held either with one hand or two hands. When the game is played, each person holds the grip on either side and plays the game. Each person playing stands firm on bis footings. While each player may move his/her body, the player who either touches ground first or moves his/her step or steps loses. The player who touches the other player also loses.

The devices under the present invention will be useful for exercise and also for the tug of war game by two persons.

Accordingly, it is an object of the present invention to provide a various two persons tug of war game apparatus.

DETAILED DESCRIPTION OF THE PREFERRED EMBODIMENTS

Figure 1:
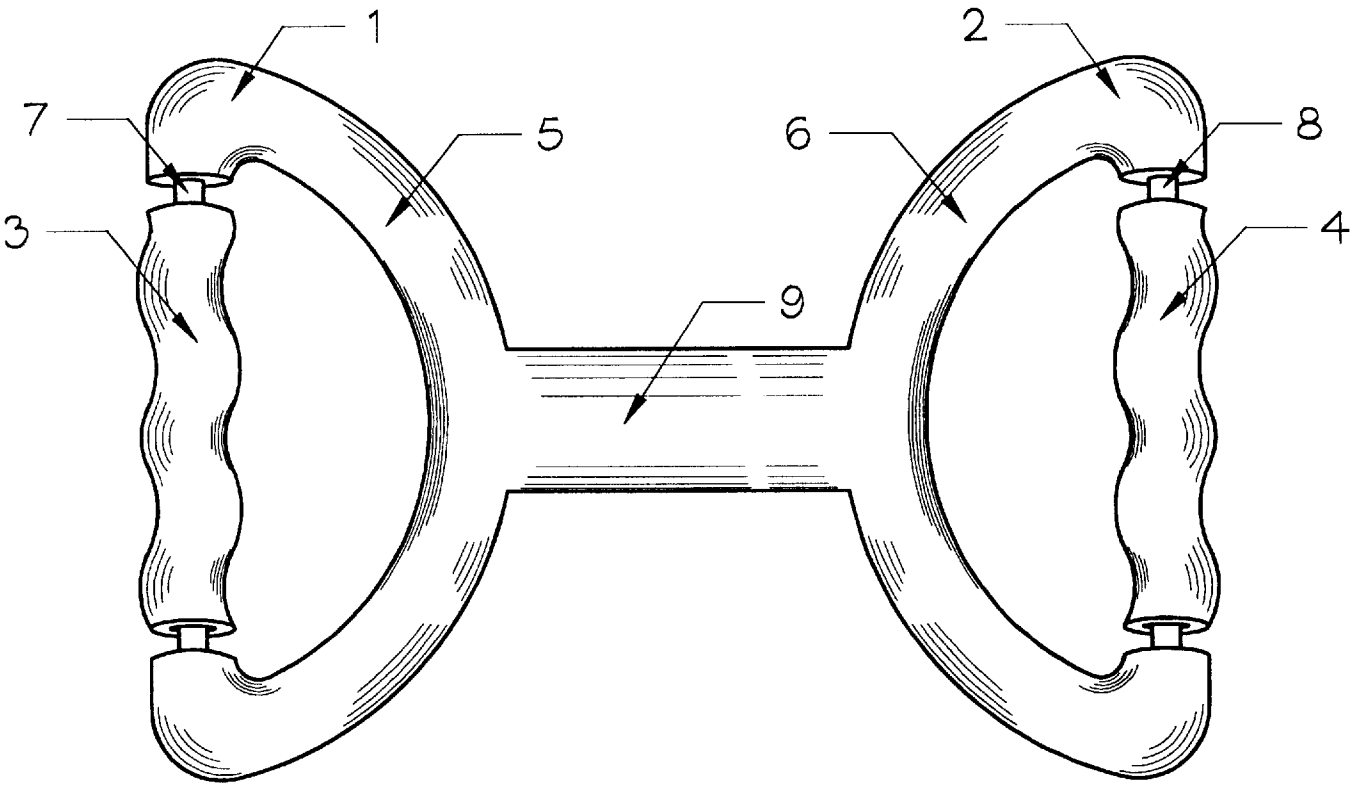
FIG. 1 is a perspective view of a first two person tug of war device.

Turning in detail to the drawings, FIG. 1 illustrates the first embodiment of a tug of war gaming device. The gaming device includes a frame 9 having a first end 1 and a second end 2. The gaming device also includes a first hand grip 3 which is rotatably mounted to a first axis 7 and a second hand grip 4 which is rotatably mounted to a second axis 8.

The first axis 7 and the second axis 8 are substantially perpendicular to the longitudinal extension of the frame 9.

Figure 2:
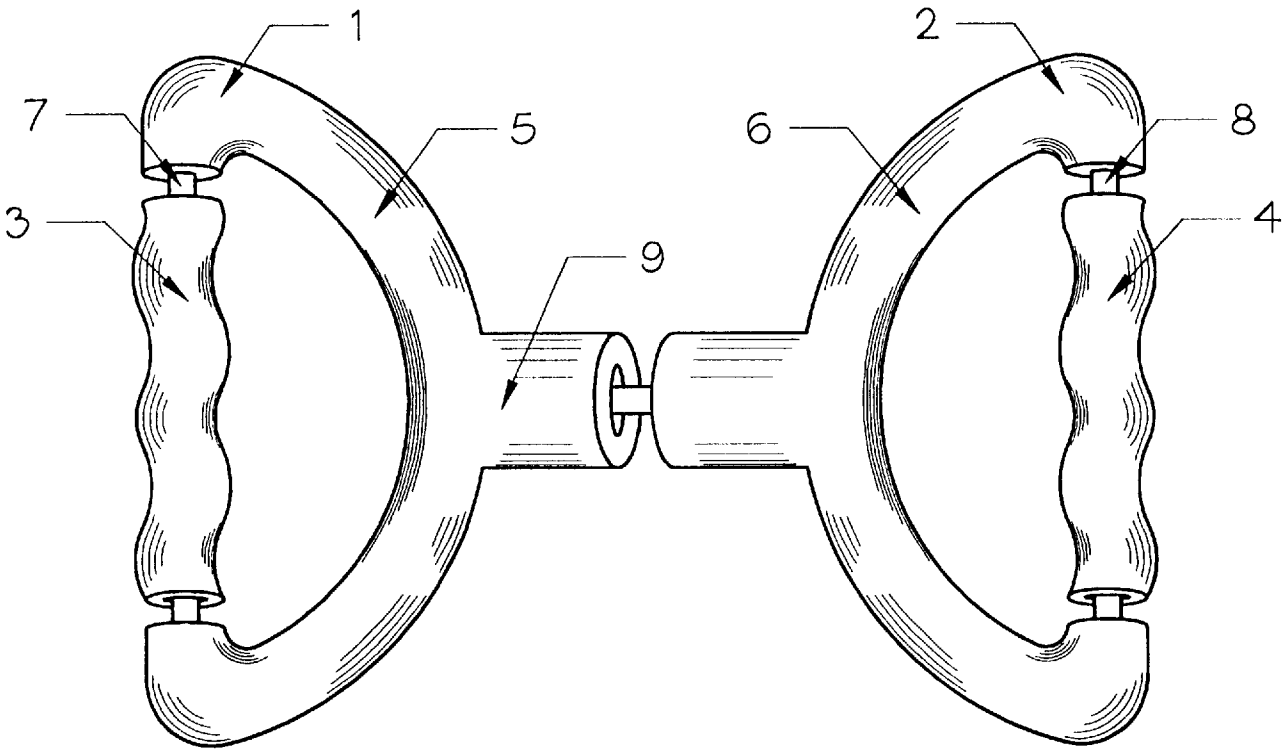
FIG. 2 is a perspective view of a second two person tug of war device.

In FIG. 2, a second embodiment of a tug of war game device is illustrated. The frame 9 includes a first section 5 and a second section 6. The first section 5 and the second section 6 are connected by a swivel joint. The swivel joint between the first section 5 and the second section 6 provides pivotal motion between the first and the second sections 5, 6 about the longitudinal extension of the frame 9 between the first end 1 and the second end 2.

Figure 3:
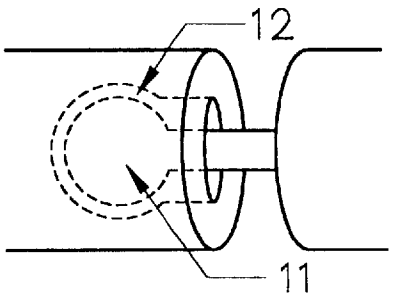
FIG. 3 is a cross-sectional view of the joint of the tug of war device illustrated in FIG. 2.

FIG. 3 illustrates the cross sectional view of the joint of the gaming device illustrated in FIG. 2. The swivel joint includes a first ball 11 and a first socket 12 allowing some angular movement between the first section 5 and the second section 6 about axes 7 and 8. The ball 11 is perpendicular to the longitudinal extension of the frame 9 between the first and the second ends 1 and 2.

Figure 4:
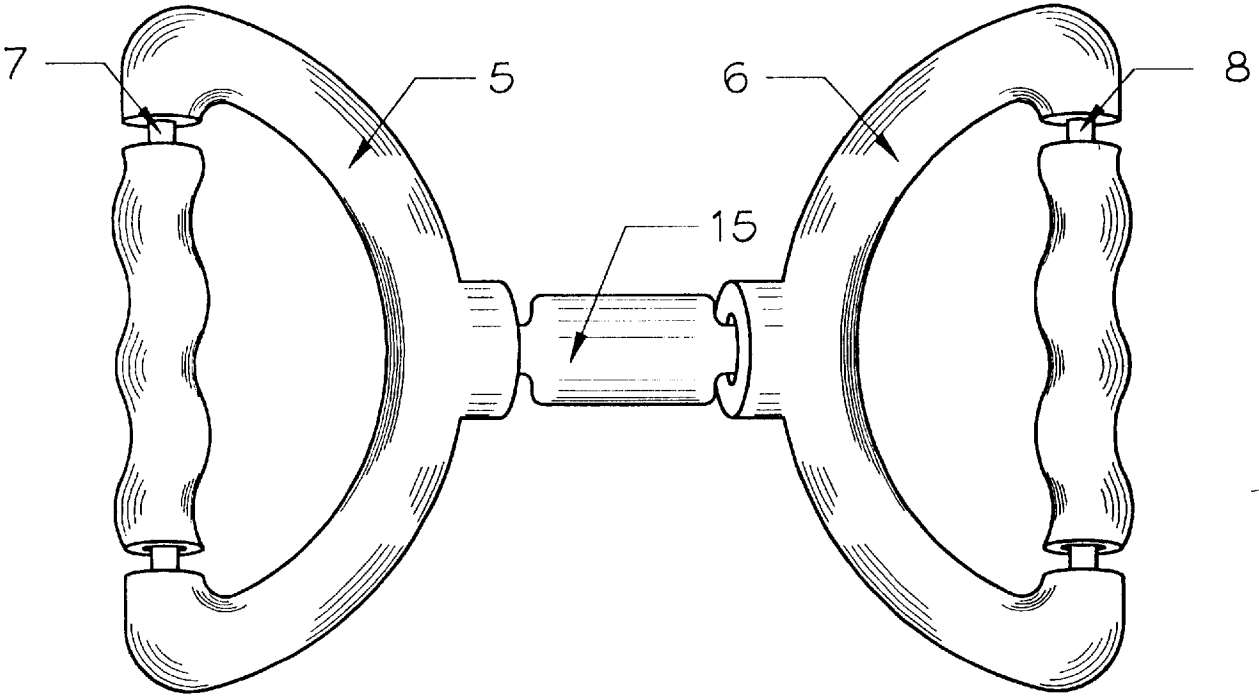
FIG. 4 is a perspective view of a third tug of war device.

FIG. 4 illustrates the third embodiment of a tug of war gaming device. This gaming device comprises the first section 5 and the second section 6 and a tie 15 having a first end 11 and a second end 13. The first end 11 is same as the first ball 11. The second end 13 of the tie 15 is a second ball 13 and the second ball 13 is rotatably connected with a second socket 14.

Figure 5:
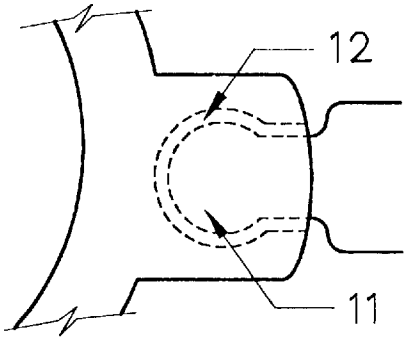
FIG. 5 is a cross-sectional view of the first swivel joint of the device illustrated in FIG. 4.

FIG. 5 is the cross-sectional view of the first swivel joint of the gaming device illustrated in FIG. 4. The swivel joint includes the first ball 11 and the first socket 12 allowing some angular movement between the first section 5 and the tie 15 about axis 7.

Figure 6:
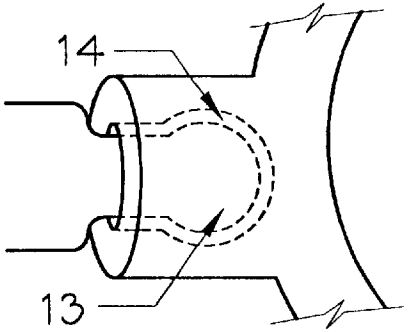
FIG. 6 is a cross-sectional view of the second swivel joint of the device illustrated in FIG. 4.

FIG. 6 is the cross sectional view of the second swivel joint of the gaming device illustrated in FIG. 4. The swivel joint includes the second ball 13 and the second socket 14 allowing some angular movement between the tie 15 and the second section 6 about axis 8.

Figure 7:
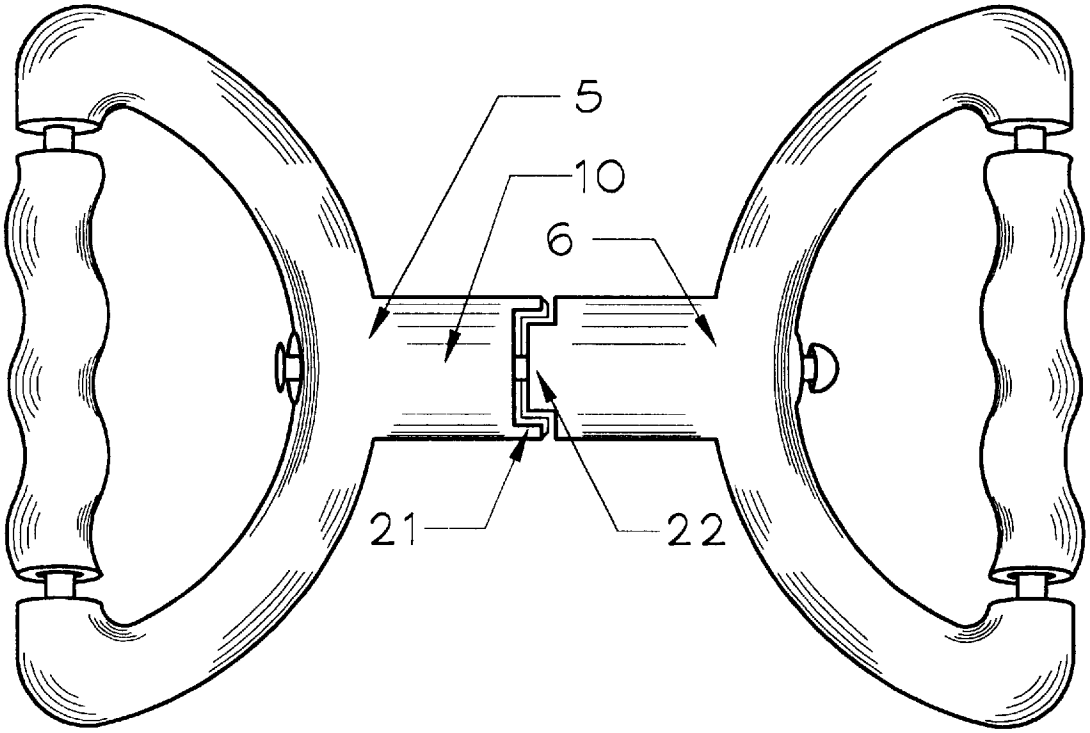
FIG. 7 is a perspective view of a fourth tug of war device.

FIG. 7 illustrates fourth embodiment of a tug of war gaming device. This embodiment includes a shaft 20 extending longitudinally along the longitudinal extension of the frame 9 between the first section 5 and the second section 6. The swivel joint has stops 21 and 22 in order to limit rotational movement of the first section 5 relative to the second section 6.

Figure 8:
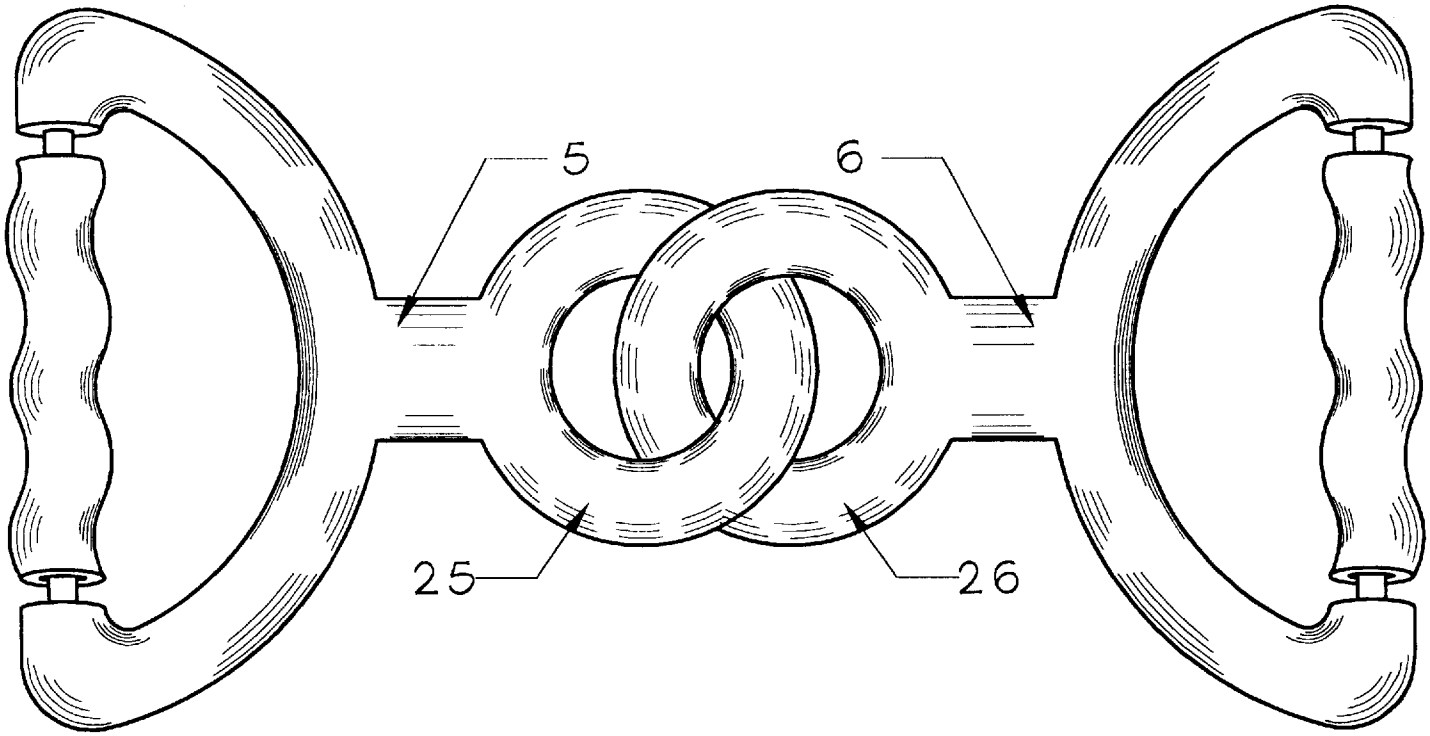
FIG. 8 is a perspective view of a fifth tug of war device.

FIG. 8 illustrates another embodiment of a tug of war gaming device. This device includes a first ring 25 on the first section 5 and a second ring 26 on the second section 6. The first ring 25 is interlocked with the second ring 26.

Figure 9:
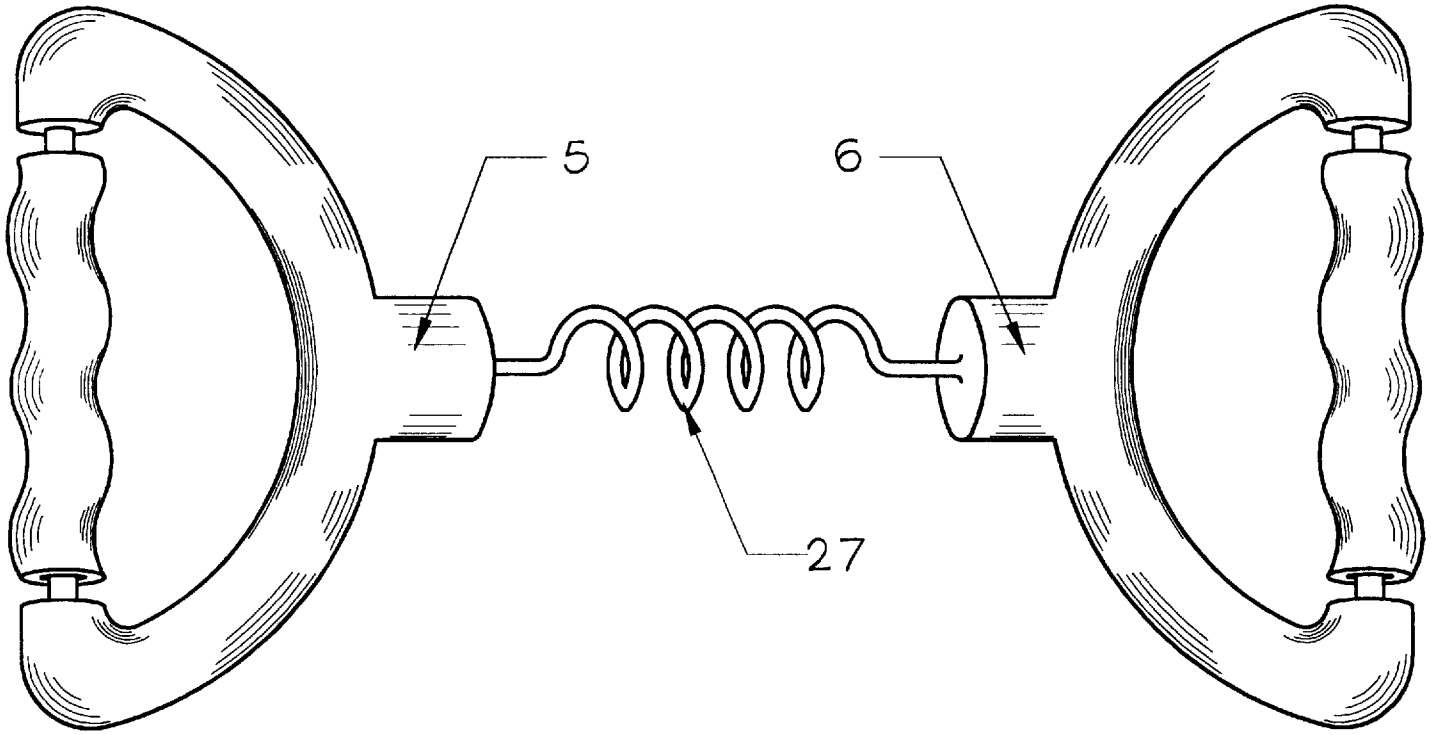
FIG. 9 is a perspective view of a sixth tug of war device.

FIG. 9 illustrates yet another embodiment of a tug of war gaming device. This device includes a spring 27, and it connects the first section 5 and the second section 6.

Figure 10:
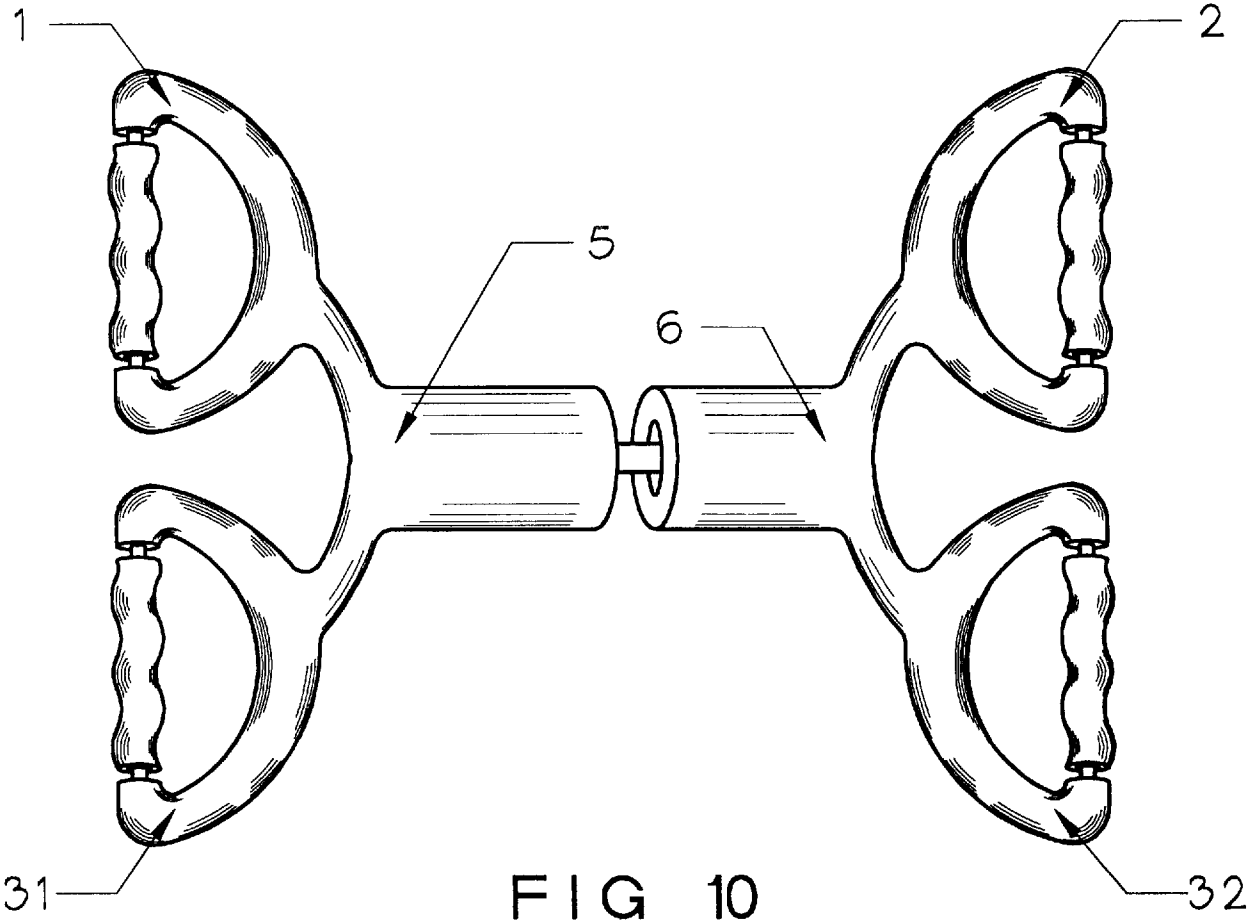
FIG. 10 is a perspective view of a seventh tug of war device.

FIG. 10 illustrates a tug of war gaming device with a plurality of hand grips. The first section 5 has hand grips 1 and 31, and the second section 6 has hand grips 2 and 32.

Figure 11:
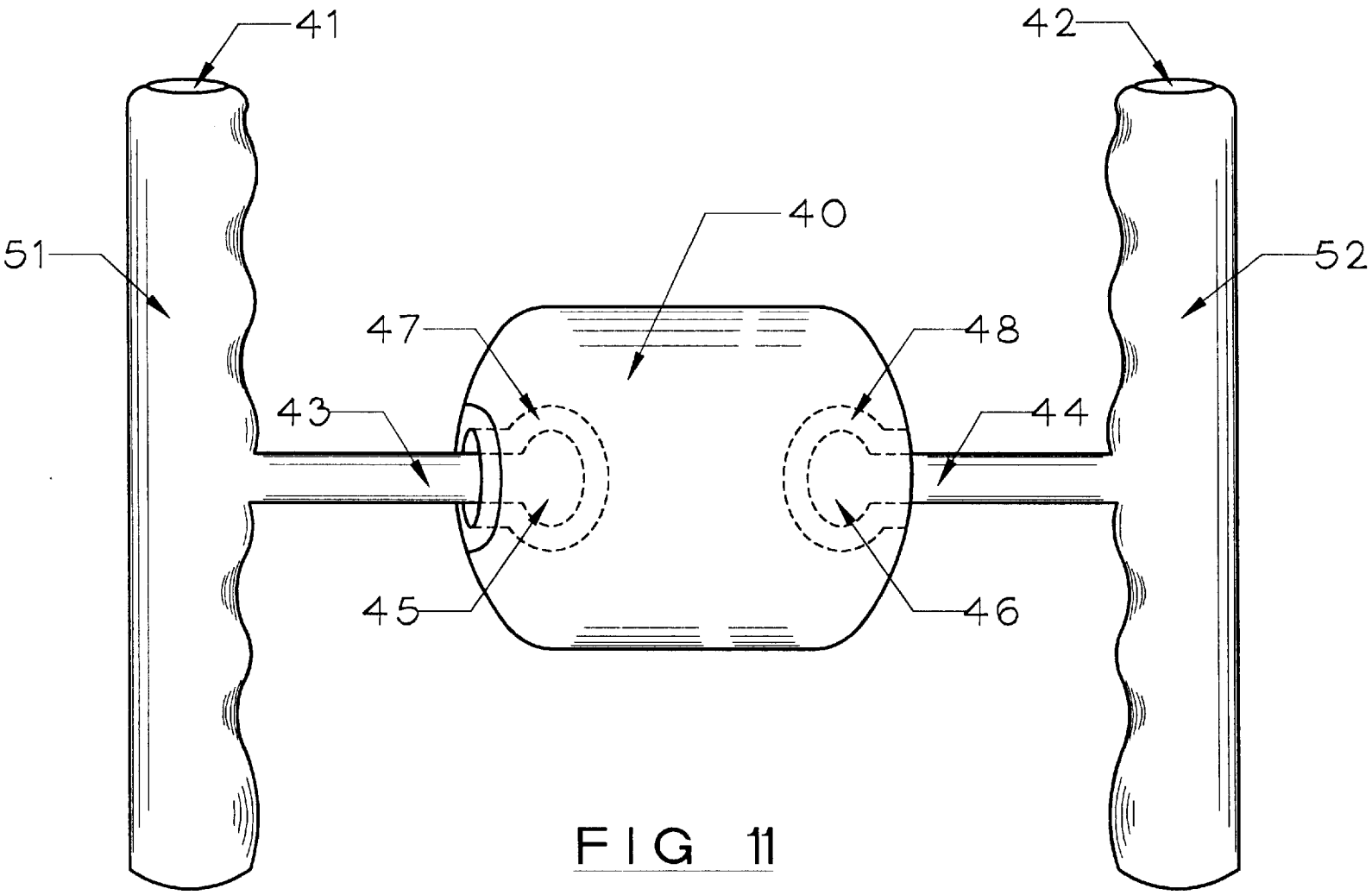
FIG. 11 is a perspective view of a eighth tug of war device.

FIG. 11 illustrates yet another tug of war gaming device. This gaming device includes a frame 40 with a first end 41 and the second end 42, the frame 40 extending longitudinally between the first end 41 and the second end 42. This device includes a first section 43 including a first end 45 and a second section 44 including a second end 46. This device has two swivel joints. The first swivel joint is between a first socket 47 of the frame 40 and the first end 45 of the first section 43. The second swivel joint is between a second socket 48 of the frame 40 and the second end 46 of the second section 44.

This device also includes a first hand grip 51 mounted to the first end 41 of the frame and a second hand grip 52 mounted to the second end 42 of the frame.

What is claimed is:

1. A gaming device comprising a frame having a first end and a second end and extending longitudinally therebetween;

a first hand grip rotatably mounted to the frame at the first end about a first axis substantially perpendicular to the longitudinal extension of the frame between the first end and the second end;

a second hand grip rotatably mounted to the frame at the second end about a second axis substantially perpendicular to the longitudinal extension of the frame between the first end and the second end.

2. The gaming device of claim 1, the frame being rigid.

3. The gaming device of claim 1, the frame being flexible.

4. The gaming device of claim 1, the frame being elastic.

5. The gaming device of claim 1, the frame including a first section including the first end, a second section including the second end, and a swivel joint between the first and the second sections to provide pivotal motion between the first and second sections about the longitudinal extension of the frame between the first end and the second end.

6. The gaming device of claim 5, the swivel joint including a first ball and a first socket allowing some angular movement between the first section and the second section about axes through the ball perpendicular to the longitudinal extension of the frame between the first end and the second end.

7. The gaming device of claim 6, the swivel joint further including a second ball, a second socket and a tie having a first end and a second end, one of the first ball and the first socket being fixed to the first end of the tie and the other of the first ball and the first socket being fixed to the first section, and one of the second ball and the second socket being fixed to the second end of the tie and the other of the second ball and the second socket being fixed to the second section.

8. The gaming device of claim 5, the swivel joint including a shaft extending longitudinally along the longitudinal extension between the first section and the second section and stops on each of the first section and the second section about the shaft to limit rotational movement of the first section relative to the second section.

9. The gaming device of claim 5, the swivel joint including a first ring on the first section and a second ring on the second section, the first and second rings being interlocking.

10. The gaming device of claim 1 further comprising a plurality of the said first hand grips at the first end;

a plurality of the said second hand grips at the second end.

11. The gaming device of claim 10, the frame having a first section including the first end, a second section including the second end, and a swivel joint between the first and the second sections to provide pivotal motion between the first and second sections about the longitudinal extension of the frame between the first end and the second end.

12. A gaming device comprising a frame including a first end, a second end, the frame extending longitudinally between the first end and the second end, a first section including the first end, a second section including the second end, and a swivel joint between the first and second sections about the longitudinal extension of the frame between the first end and the second end;

a first hand grip mounted to the frame at the first end;

a second hand grip mounted to the frame at the second end.

13. The gaming device of claim 12, the swivel joint including a first ball and a first socket allowing some angular movement between the first section and the second section about an axis through the ball perpendicular to the longitudinal extension of the frame between the first end and the second end.

14. The gaming device of claim 12, the swivel joint including a tie, a first ball, a first socket receiving the first ball, a second ball and a second socket receiving the second ball, the tie including one of the first ball and the first socket and the first section including the other of the first ball and the first socket, the tie including one of the second ball and the second socket and the second section including the other of the second ball and the second socket.

15. The gaming device of claim 14, the first ball and the first socket allowing some angular movement between the first section and the tie about axes through the first ball perpendicular to the longitudinal extension of the frame between the first section and the tie, and the second ball and the second socket allowing some angular movement between the second section and the tie about axes through the second ball perpendicular to the longitudinal extension of the frame between the tie and the second end.

16. The gaming device of claim 12, the swivel joint including a shaft extending longitudinally along the longitudinal extension between the first section and the second section and stops on each of the first section and the second section about the shaft to limit rotational movement of the first section relative to the second section.

17. The gaming device of claim 12, the swivel joint including a first ring on the first section and a second ring on the second section, the first and second rings being interlocking.

18. The gaming device of claim 5 further comprising a plurality of the said first hand grips at the first end;

a plurality of the said second hand grips at the second end.

19. The gaming device of claim 12 further comprising a plurality of the said first hand grips at the first end;

a plurality of the said second hand grips at the second end.

* * * * *